US011585206B2

(12) United States Patent
Ansari et al.

(10) Patent No.: US 11,585,206 B2
(45) Date of Patent: Feb. 21, 2023

(54) INJECTION OF ADDITIVES INTO A PRODUCED HYDROCARBON LINE

(71) Applicant: Saudi Arabian Oil Company, Dhahran (SA)

(72) Inventors: Nisar Ahmad Ansari, Ras Tanura (SA); Mohamed Soliman, Ras Tanura (SA); Samusideen Adewale Salu, Ras Tanura (SA); Talal Al-Zahrani, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/196,210

(22) Filed: Mar. 9, 2021

(65) Prior Publication Data

US 2022/0290551 A1 Sep. 15, 2022

(51) Int. Cl.

| | |
|---|---|
| ***E21B 47/06*** | (2012.01) |
| ***E21B 47/00*** | (2012.01) |
| ***E21B 34/02*** | (2006.01) |
| ***E21B 43/16*** | (2006.01) |

(52) U.S. Cl.

CPC ..... *E21B 47/006* (2020.05); *E21B 34/025* (2020.05); *E21B 43/16* (2013.01); *E21B 47/06* (2013.01)

(58) Field of Classification Search

CPC ..... E21B 17/006; E21B 34/025; E21B 43/16; E21B 47/06

See application file for complete search history.

(56) References Cited

U.S. PATENT DOCUMENTS

| | | | |
|---|---|---|---|
| 5,176,164 | A | 1/1993 | Boyle |
| 5,209,301 | A | 5/1993 | Ayres |
| 5,343,941 | A | 9/1994 | Raybon |
| 6,170,703 | B1 | 1/2001 | Butler et al. |
| 6,767,877 | B2 | 7/2004 | Kuo et al. |
| 6,779,548 | B2 | 8/2004 | McKeary |
| 7,066,353 | B2 | 6/2006 | Hammonds |
| 8,584,691 | B2 | 11/2013 | Hammonds |

(Continued)

FOREIGN PATENT DOCUMENTS

| | | | |
|---|---|---|---|
| CA | 3066565 | A1 | 7/2020 |
| EP | 0749058 | A2 | 12/1996 |

OTHER PUBLICATIONS

International Search Report and Written Opinion dated May 24, 2018 of related application PCT/US2018/012907.

(Continued)

*Primary Examiner* — Silvana C Runyan

(74) *Attorney, Agent, or Firm* — Bracewell LLP; Constance G. Rhebergen; Keith R. Derrington

(57) ABSTRACT

Additive is introduced into a tubular that carries produced fluid from a wellhead; the additive addition prophylactically guards against damage to the tubular, such as from corrosion or oxidation. Gas from the wellhead is utilized as a pressure source for driving the additive into the tubular. The rate of additive injection is varied based on characteristics of the tubular or fluid in the tubular. Characteristics of the fluid in the tubular include iron content, residual additive, moisture content, and flowrate; characteristics of the tubular include its corrosion rate of the tubular. The characteristics are measured real time, measured historically, or predicted from a model.

15 Claims, 3 Drawing Sheets

(56) References Cited

U.S. PATENT DOCUMENTS

| | | | | |
|---|---|---|---|---|
| 9,085,975 | B2 | 7/2015 | Abad | |
| 9,341,058 | B2 * | 5/2016 | Keizer | C02F 1/008 |
| 9,790,775 | B2 | 10/2017 | Joseph et al. | |
| 10,047,303 | B2 | 8/2018 | Rustad et al. | |
| 10,435,989 | B2 | 10/2019 | Peng et al. | |
| 2004/0084081 | A1 | 5/2004 | Liu et al. | |
| 2009/0149356 | A1 * | 6/2009 | Tiwari | C23F 11/167 507/243 |
| 2010/0224365 | A1 * | 9/2010 | Abad | E21B 43/26 166/275 |
| 2014/0078499 | A1 * | 3/2014 | Tunheim | G01N 21/954 356/241.1 |
| 2014/0186210 | A1 * | 7/2014 | Gill | C09K 15/30 252/389.52 |
| 2016/0009488 | A1 | 1/2016 | Hudalla et al. | |
| 2016/0115395 | A1 * | 4/2016 | Rustad | E21B 47/06 700/282 |
| 2017/0241930 | A1 * | 8/2017 | Roberts | G01N 33/2823 |
| 2018/0051549 | A1 | 2/2018 | Holyfield | |

OTHER PUBLICATIONS

Forbes Marshall Steam Operated Condensate Pump, found at www.forbesmarshall.com/fm_micro/Products5.aspx?

M. Daas, Downhole Chemical Injection Through Gas Lift: Options and Consequences, Jun. 14-17-2011.

Spirax Sarco Ogden Automatic Pump Insstruction Manual, IM-P015-12 ST Issue 3, 1998.

TLV Power Trap, found at www.tlv.com/global/US/product-operation/powertrap-gp10.html.

Perry's Chemical Engineer's Handbook, "Flow Through Orifices", 7th Edition, Fluid and Particle Dynamics, pp. 6-21 and 6-22.

* cited by examiner

INJECTION OF ADDITIVES INTO A PRODUCED HYDROCARBON LINE

BACKGROUND OF THE INVENTION

1. Field of Invention

The present disclosure relates to injecting additives into a hydrocarbon stream produced from a wellbore. In particular, the present disclosure relates to using gas from a wellbore to provide a motive force for injecting additives into a hydrocarbon stream produced from the wellbore.

2. Description of Prior Art

During manufacturing or production processes that handle fluids, chemicals or other additives are sometimes introduced into the fluid, typically when the fluid is flowing within piping or a transmission line, or when being stored in a vessel. The additive is sometimes used for adjusting properties of the primary material, such as its density, viscosity, pH, freezing/boiling point, and the like. On occasion the injection substance adjusts properties or characteristics of the primary material so that the handling equipment (for example, pipes, valves, fittings) is less susceptible to damage. Chemical injection substances are also used to assist processes in industry such as demulsification, deoxygenation, or inhibit undesirable processes such as corrosion, scaling and deposition.

Conventional systems for injective additives into fluids to be treated typically include tanks, pumps, valves, and instrumentation. Traditional injection systems often employ pumps for directing the additive to an injection site, and arrive at a pressure sufficient for injection into the fluid. The pumps are usually reciprocating and driven by electrically powered motors. The pumps, motor, and couplings engaging the pump and motor all require inspection and maintenance. Moreover, injection capability can be lost through mechanical failure of the pump or motor, or a loss of electrical supply to the motor.

SUMMARY OF THE INVENTION

An example of a method of handling fluid produced from a wellbore is disclosed and that includes directing the fluid away from the wellbore by flowing the fluid through a transmission line, injecting an additive into the transmission line, and communicating pressure from the wellbore to the additive to drive the additive into the transmission line. The method optionally further includes monitoring a characteristic inside of the transmission line, and wherein an amount of the additive being injected into the transmission line is based on the monitored characteristic. In this example the characteristic is iron content of the fluid inside the transmission line, or residual additive of the fluid inside the transmission line and at a location downstream of where the additive is being injected, or a rate of corrosion inside the transmission line. In an example, the rate of corrosion is monitored at a location upstream of where the additive is being injected into the transmission line and at a location downstream of where the additive is being injected into the transmission line. In another example, the characteristic is a moisture content of the fluid, and wherein the additive comprises a corrosion inhibitor. Alternatives exist in which the characteristics are monitored real time, and wherein the amount of additive being injected into the transmission line is also based on a predictive model derived using characteristics monitored historically. In an example, where the additive is injected into the transmission line defines an injection location, the characteristic is temperature and is monitored upstream of the injection location, the method further includes monitoring characteristics of pressure, fluid flowrate, and a first corrosion rate upstream of the injection location, monitoring characteristics of a first moisture percent and a first iron content downstream of the injection location, monitoring characteristics of a second corrosion rate, a second iron content, a residual additive, and a second moisture content, at a terminal location that is distal from the wellbore, and basing the amount of additive being injected into the transmission line on the monitored characteristics. The method optionally further includes reducing pressure in the transmission line upstream of where the additive is being injected. The fluid can be fluid from multiple wellbores.

Another example method of handling fluid produced from a wellbore is disclosed and that involves monitoring a flow rate and moisture percent of the fluid and that is flowing inside the transmission line, injecting an additive into the transmission line at a rate that is based on the gas flow rate and the moisture percent, monitoring a characteristic in the transmission line such as a corrosion rate in the transmission line, iron content of the fluid in the line, an amount of residual additive in the fluid, and combinations, and at a location that is downstream of where the additive is injected, and adjusting a rate of the additive injected into the transmission line based on the monitored characteristic. In one embodiment the additive is a corrosion inhibitor. The method optionally includes altering the flow rate of the fluid flowing inside the transmission line by adjusting a percent opening of a choke valve disposed in the transmission line. The corrosion rate is alternatively measured downstream of where the additive is injected into the transmission line, the method further includes measuring a corrosion rate upstream of where the additive is injected into the transmission line, and where the monitored characteristics are corrosion rates measured upstream and downstream of where the additive is injected into the transmission line.

Another example method is disclosed for handling fluid produced from a wellbore, and that includes flowing the fluid to a destination away from the wellbore and through a transmission line; monitoring characteristics in the transmission line, and obtaining a model correlating iron content and residual additive in the fluid. This example method also includes injecting an amount of the additive into the transmission line to minimize iron content and residual additive in the fluid at the destination, and the additive is a corrosion inhibitor, and the model is obtained from historical data. Examples of the characteristics are temperature, pressure, fluid flow rate, and corrosion rate at a location upstream of where the additive is injected, iron content in the fluid at a location downstream of where the additive is injected, a corrosion rate, an iron content in the fluid, residual additive in the fluid, moisture content of the fluid at the destination, and combinations.

BRIEF DESCRIPTION OF DRAWINGS

Some of the features and benefits of the present invention having been stated, others will become apparent as the description proceeds when taken in conjunction with the accompanying drawings, in which.

Figure 1:
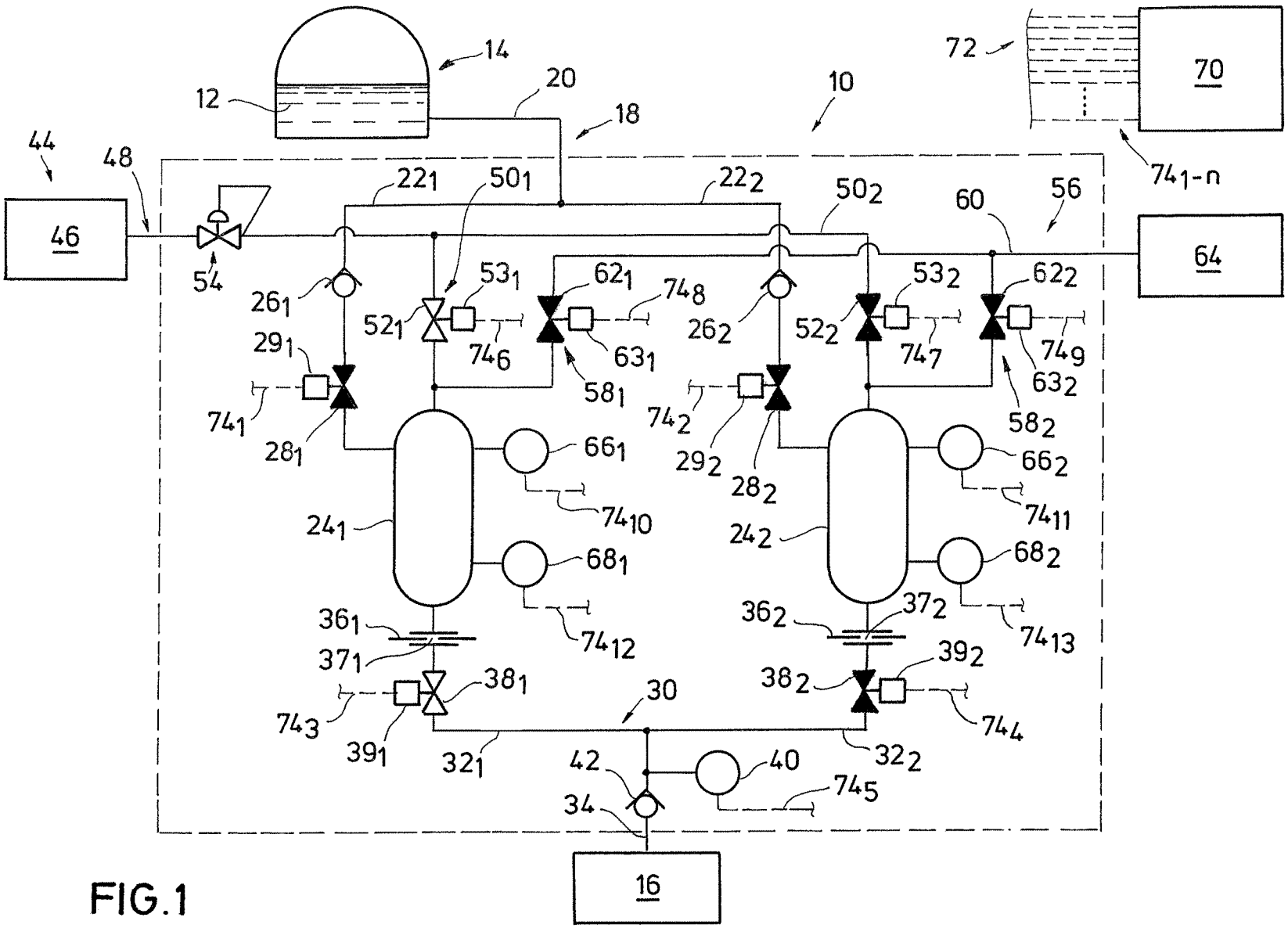
FIG. 1 is a schematic view of an example of an additive injection system

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown schematically in FIG. 1 is an example of a chemical injection system 10 for directing additive 12 housed within storage tank 14 into an injection location 16. Examples exist where the additive 12 is solid, liquid/gas, or two-phase, and is used for adjusting properties of substances, such as fluids, gases or solids, contained within the injection location 16. In embodiments a solid additive 12 is combined with a liquid to form a slurry, or solubilized into a liquid Examples of the injection location 16 include processing facilities (not shown), such as plants for synthesizing chemicals, or those that isolate components of feed stock, such as refineries. In an embodiment the injection location 16 further includes storage containers, as well as transmission lines that transmit various fluids, such as crude oil, water, hydrocarbons, or mixtures thereof.

The system 10 of FIG. 1 includes an injection material inlet circuit 18 shown having injection material inlet line 20 and injection material inlet leads $\mathbf{22}_1$, $\mathbf{22}_2$ that extend from an end of the injection material chemical inlet line 20. The illustrated example of the inlet line 20 has one end in communication with the additive 12 within storage tank 14 and an opposite end in communication with the leads $\mathbf{22}_1$, $\mathbf{22}_2$. The leads $\mathbf{22}_1$, $\mathbf{22}_2$ of this example have ends distal from the inlet line 20 that respectfully connect to vessels $\mathbf{24}_1$, $\mathbf{24}_2$, and in which the additive 12 is transported from the storage tank 14 to the vessels $\mathbf{24}_1$, $\mathbf{24}_2$. Optional check valves $\mathbf{26}_1$, $\mathbf{26}_2$ are provided within inlet leads $\mathbf{22}_1$, $\mathbf{22}_2$. The check vales $\mathbf{26}_1$, $\mathbf{26}_2$ block flow from vessels $\mathbf{24}_1$, $\mathbf{24}_2$ back to inlet line 20, while allowing flow in a direction from inlet line 20 and into vessels $\mathbf{24}_1$, $\mathbf{24}_2$. Injection material inlet valves $\mathbf{28}_1$, $\mathbf{28}_2$ are provided respectively in the inlet leads $\mathbf{22}_1$, $\mathbf{22}_2$ and which in an example are selectively opened or closed to thereby control the inflow of the additive 12 into the vessels $\mathbf{24}_1$, $\mathbf{24}_2$.

Motors $\mathbf{29}_1$, $\mathbf{29}_2$ are optionally provided that generate an actuating force for opening and closing valves $\mathbf{28}_1$, $\mathbf{28}_2$. A discharge circuit 30 is included in the example of FIG. 1, and shown being made up of piping for transferring the additive 12 from vessels $\mathbf{24}_1$, $\mathbf{24}_2$ and into the injection location 16. Discharge leads $\mathbf{32}_1$, $\mathbf{32}_2$ are included with the illustrated discharge circuit 30, and which have ends connected respectively to outlet ports of vessels $\mathbf{24}_1$, $\mathbf{24}_2$ and opposite ends that terminate at a discharge line 34. Discharge leads $\mathbf{32}_1$, $\mathbf{32}_2$ provide selective communication between vessels $\mathbf{24}_1$, $\mathbf{24}_2$ and discharge line 34. An end of discharge line 34 opposite the discharge leads $\mathbf{32}_1$, $\mathbf{32}_2$ couples with the injection location 16. In the illustrated example, orifice members $\mathbf{36}_1$, $\mathbf{36}_2$ are respectively disposed in discharge leads $\mathbf{32}_1$, $\mathbf{32}_2$. In the example of FIG. 1, the orifice members $\mathbf{36}_1$, $\mathbf{36}_2$ are generally planar and have openings $\mathbf{37}_1$, $\mathbf{37}_2$ that are strategically sized to meter a designated amount of the additive 12 through discharge leads $\mathbf{32}_1$, $\mathbf{32}_2$ and onto the injection location 16. In one embodiment cross-sectional areas of the openings $\mathbf{37}_1$, $\mathbf{37}_2$ are less than cross-sectional areas in the discharge leads $\mathbf{32}_1$, $\mathbf{32}_2$. Examples exist where the designated amount is an amount of flow per time, such as mass or weight per time of the additive 12 (for example, kilograms per hour ["kg/hr"]), or a volume of the additive 12 per time (for example, cubic meters/hour ["$m^3$/hr"]). Optionally, the designated amount is a total mass, weight, or volume of the additive 12. It is well within the capabilities of those skilled in the art to provide orifice members $\mathbf{36}_1$, $\mathbf{36}_2$ with openings $\mathbf{37}_1$, $\mathbf{37}_2$ of a size to achieve a designated amount of flow of the additive 12 into the injection location 16. In an alternative, control valves (not shown) are used in place of the orifice members $\mathbf{36}_1$, $\mathbf{36}_2$ to regulate the amount of flow of the additive 12. Embodiments of the alternative control valves include ball valves or gate valves with openings selectively adjusted to varying cross sectional areas. Injection material outlet valves $\mathbf{38}_1$, $\mathbf{38}_2$ are shown disposed within the leads $\mathbf{32}_1$, $\mathbf{32}_2$, and which selectively allow or block flow through leads $\mathbf{32}_1$, $\mathbf{32}_2$ when opened or closed by energizing valve motors $\mathbf{39}_1$, $\mathbf{39}_2$. Further in the illustrated example is an optional flow indicator 40 that is in communication with discharge line 34, and that monitors the amount of additive 12 within outlet line 34. In the illustrated embodiment a check valve 42 is included within outlet line 34 that permits flow of additive 12 from the vessels $\mathbf{24}_1$, $\mathbf{24}_2$ to the injection location 16 while restricting flow from the injection location 16 and back to vessels $\mathbf{24}_1$, $\mathbf{24}_2$.

Still referring to FIG. 1 the example of the chemical injection system 10 further includes an injection pressure circuit 44 that selectively pressurizes vessels $\mathbf{24}_1$, $\mathbf{24}_2$ to a specified pressure. Pressurizing vessels $\mathbf{24}_1$, $\mathbf{24}_2$ to a specified value generates a certain motive force so that flow of the additive 12 into the injection location 16 is substantially at a designated amount of flow. In an example, a designated amount of flow is dictated by the needs of the primary fluids for material located within injection location 16. Included within the injection pressure circuit 44 is an injection pressure source 46. Examples of a pressure source 46 include a flow line having pressurized fluid, a tank having pressurized fluid, a compressor, a pump, or any other known or later developed means or device for providing a pressurized fluid. Examples of pressurized fluid include any gas or vapor, such as air or nitrogen. As described in further detail, the magnitude of the pressure is that which is sufficient to drive the designated amount of flow of the additive 12 to and into the injection location 16. Further illustrated in this example is a discharge of the injection pressure source 46 connected to an injection pressure inlet line 48, that in combination with injection pressure inlet leads $\mathbf{50}_1$, $\mathbf{50}_2$, selectively communicate the pressurized fluid from the injection pressure source 46 to the vessels $\mathbf{24}_1$, $\mathbf{24}_2$. In an embodiment, an injection pressure inlet valve $\mathbf{52}_2$ is included within injection pressure inlet line 48 between vessel $\mathbf{24}_2$ and a pressure control valve 54. Injection pressure inlet valve $\mathbf{52}_2$ is selectively opened and closed to block or allow communication between pressure control valve 54 and vessel. $\mathbf{24}_2$. The pressure control valve 54 is configured so that its downstream side and injection pressure inlet leads $\mathbf{50}_1$, $\mathbf{50}_2$ are maintained at a certain pressure, in this example the combination of pressure within vessels $\mathbf{24}_1$, $\mathbf{24}_2$ and the cross-sectional area in the openings $\mathbf{37}_1$, $\mathbf{37}_2$ or orifice members $\mathbf{36}_1$, $\mathbf{36}_2$ delivers the additive 12 into the injection location 16 at a rate that is substantially the same as a designated amount of flow. Similarly, valve motors $\mathbf{53}_1$, $\mathbf{53}_2$ are shown coupled to injection pressure inlet valves $\mathbf{52}_1$, $\mathbf{52}_2$ and which actuate the valves $\mathbf{52}_1$, $\mathbf{52}_2$ selectively into or between open and closed positions. In an example, the rate of additive 12 delivered to the injection location 16 is changed by adjusting the pressure control valve 54 to alter fluid pressure downstream of the pressure control valve 54 and to one (or both) of the vessels $\mathbf{24}_1$, $\mathbf{24}_2$ that is (are) dispensing the additive 12.

In an alternative, injection system 10 includes a pressure discharge circuit 56 shown having pressure discharge leads $\mathbf{58}_1$, $\mathbf{58}_2$ whose ends are in fluid communication respectively with vessels $\mathbf{24}_1$, $\mathbf{24}_2$. In the illustrated example, the pressure discharge leads $\mathbf{58}_1$, $\mathbf{58}_2$ physically connect to injection pressure inlet leads $\mathbf{50}_1$, $\mathbf{50}_2$; in an alternative the pressure discharge leads $\mathbf{58}_1$, $\mathbf{58}_2$ are coupled directly onto vessels $\mathbf{24}_1$, $\mathbf{24}_2$. Ends of the pressure discharge leads $\mathbf{58}_1$, $\mathbf{58}_2$ distal from the injection pressure inlet leads $\mathbf{50}_1$, $\mathbf{50}_2$ terminate into a pressure discharge line 60. Discharge valves $\mathbf{62}_1$, $\mathbf{62}_2$ are shown integrally disposed within pressure discharge leads $\mathbf{58}_1$, $\mathbf{58}_2$. Valve motors $\mathbf{63}_1$, $\mathbf{63}_2$ selectively open and close valves $\mathbf{62}_1$, $\mathbf{62}_2$ to allow or block pressure communication through leads $\mathbf{58}_1$, $\mathbf{58}_2$. An end of pressure discharge line 60 distal from discharge valves $\mathbf{62}_1$, $\mathbf{62}_2$ terminates at a recycle/recovery system 64.

Pressure indicators $\mathbf{66}_1$, $\mathbf{66}_2$ are illustrated respectively coupled onto vessels $\mathbf{24}_1$, $\mathbf{24}_2$, that provide an indication of pressure within vessels $\mathbf{24}_1$, $\mathbf{24}_2$ and that optionally generate a signal representative of a pressure sensed within the vessels $\mathbf{24}_1$, $\mathbf{24}_2$. Level indicators $\mathbf{68}_1$, $\mathbf{68}_2$ are also depicted in the illustrated example, that in an alternative detect a level of injection fluid 12 disposed within vessels $\mathbf{24}_1$, $\mathbf{24}_2$, and that optionally transmit signals representative of the monitored level. Further schematically illustrated is an example of a controller 70 which in an embodiment is in communication with some or all components of the chemical injections system 10 via a communication means 72. In an alternative, controller 70 includes an information handling system that optionally encompasses a processor, memory accessible by the processor, nonvolatile storage area accessible by the processor, and logics for performing each of the steps described. In the illustrated example, the communication means 72 is made up of a number of signal lines 741, which in alternatives are hard wired, wireless telemetry, pneumatic, and other forms of communication between operations hardware, and combinations thereof. In an example, "1-n" represents "1 through n."

Further in the example of FIG. 1, injection pressure inlet valve $\mathbf{52}_1$ is shown in outline form to represent an open configuration so that pressure inlet line 48 is in communication with vessel $\mathbf{24}_1$ through injection pressure inlet lead $\mathbf{50}_1$ and pressure inlet valve $\mathbf{52}_1$. In the illustrated example, the pressure in vessel $\mathbf{24}_1$ is substantially the same as that in line 48 downstream of pressure valve 54. In contrast, injection pressure inlet valve $\mathbf{52}_2$, which is shown in solid form to represent a closed configuration, and when in the closed configuration blocks communication and a flow of pressurized fluid from line 48 and into vessel $\mathbf{24}_2$. Additionally in this example, injection material outlet valve $\mathbf{38}_1$ is also in an open configuration, which can be accomplished via operation of motor $\mathbf{39}_1$, so that injection material within vessel $\mathbf{24}_1$ flows through discharge lead $\mathbf{32}_1$, discharge line 34, and to the injection location 16. As indicated previously, the amount of flow of additive 12 being delivered to injection location 16 is a function of the driving pressure within vessel $\mathbf{24}_1$, and the ratios of cross sectional areas of the lead line $\mathbf{32}_1$, and the reduced cross sectional area of opening $\mathbf{37}_1$ in orifice member $\mathbf{36}_1$. An advantage of the method and system described is that the need for pumps to inject the additive 12 is eliminated; which improves reliability while reducing cost for providing an injection material. Similarly, additive 12 is introduced into vessel $\mathbf{24}_2$ by opening valve $\mathbf{52}_2$. An example of operation of injection system 10 is provided in Ansari et al., U.S. Pat. No. 10,671,099, which is assigned to assignee of the present application and is incorporated by reference herein in its entirety and for all purposes.

Figure 2:
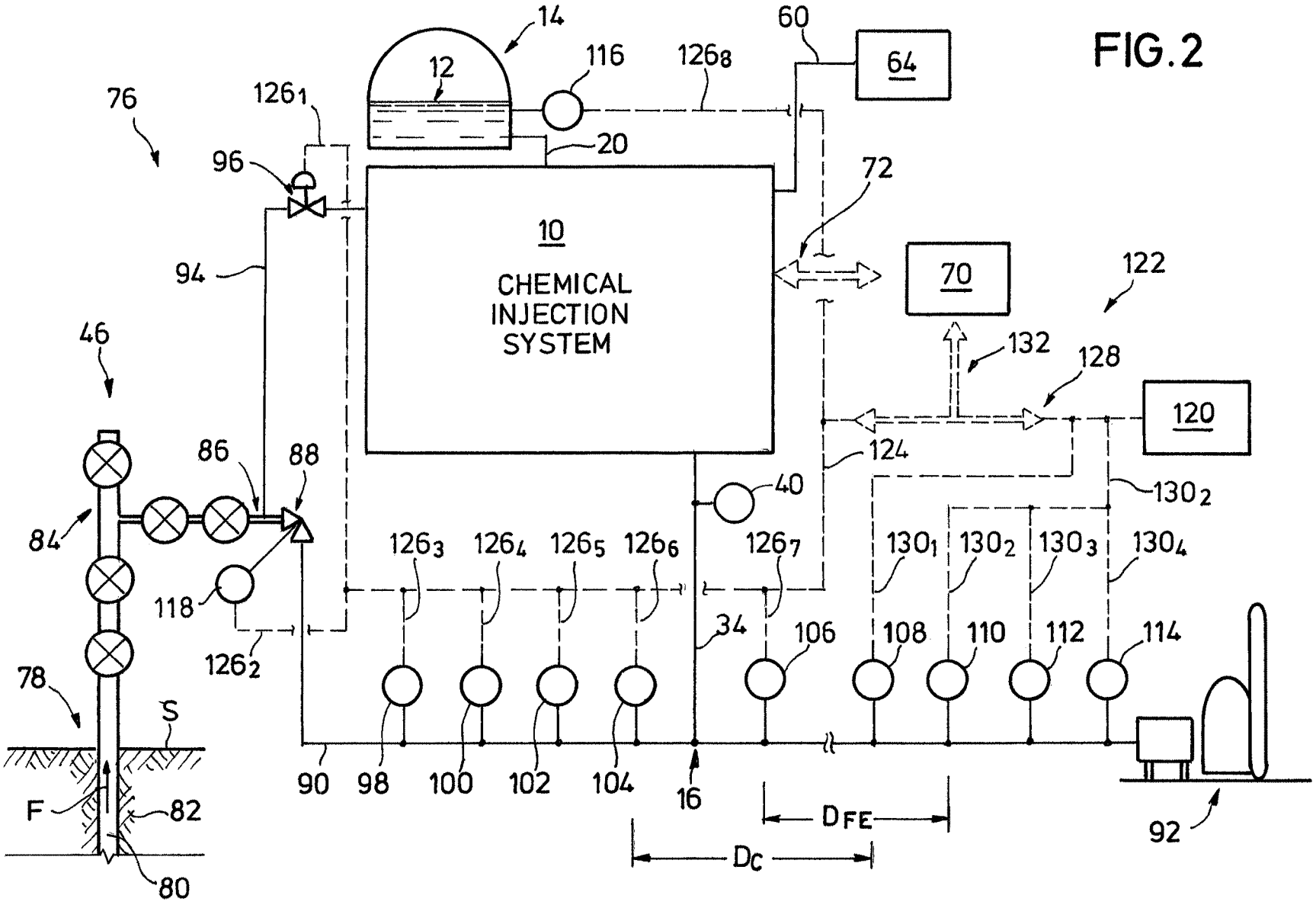
FIG. 2 is a schematic of an example of injecting additive to a wellhead production line using the injection system of FIG. 1.

Referring now to FIG. 2, shown is a schematic example of a wellbore fluid production system 76 for producing fluid F. In the example of FIG. 2, wellbore fluid production system 76 includes a chemical injection system 10 shown in function block diagram form. The chemical injection system 10 is shown deployed adjacent a wellsite 78 that includes a well 80 for producing fluid F from a subterranean formation 82. Examples of fluid F produced from well 80 include liquid hydrocarbon, water, gas hydrocarbon, and combinations. In the illustrated example, fluid F enters well 80 from formation 82, fluid F is directed from well 80 to a wellhead 84 on surface S, and routed into a production line 86 shown extending laterally from wellhead 84. Shown in production line 86 is a choke valve 88 that is selectively adjusted to different opening percentages. In an example fluid F experiences a pressure drop by flowing through choke valve 88, and the pressure drop is selectively changed by optionally adjusting the percent open of the choke valve 88. In the example of FIG. 2 fluid F flows into a transmission line 90 after exiting choke valve 88. Transmission line 90 of FIG. 2 directs the fluid F to a terminal 92 that is located distal from wellsite 78, which in the example shown is processing facility that processes the fluid F. A portion of the fluid F flowing in production line 86 is routed to the chemical injection system 10 through a lead 94 that ties into production line 86 upstream of choke valve 88. In the example of FIG. 2, fluid F in lead 94 does not flow across choke valve 88 and is at a pressure sufficiently higher than pressure of fluid F in line 90 to drive additive 12 in the chemical injection system 10 into transmission line 90. In the example of FIG. 2, well 80 operates as the injection pressure source 46 (FIG. 1). A control valve 96 is provided in the lead 94, and as will be described in more detail below provides a means of reducing pressure of fluid F upstream of the chemical injection system 10.

In the example of FIG. 2 injection location 16 is where discharge line 34 intersects with transmission line 90, which is downstream of choke valve 88. Further shown in FIG. 2 are sensors 98, 100, 102, 104 mounted to transmission line 90 upstream of the injection location 16, and that are in sensing communication with transmission line 90 and with fluid F flowing inside transmission line 90. In the example shown, sensor 98 measures temperature within line 90, sensor 100 measures pressure within line 90, sensor 102 measures a flow rate of the fluid F flowing within line 90, and sensor 104 provides an indication of corrosion rate of the line 90 and on its inner surface. Example corrosion rate units include mils per year ("MPY"), where mils is 1/1000 of an inch alternative units include mm/yr (millimeters/year). An example of a normally accepted rate of corrosion in industry is 3 MPY. Downstream of injection location 16 is sensor 106, which is shown in this example to sense an iron content of fluid F flowing within line 90. Additional sensors 108, 110, 112, 114 are shown mounted to transmission line 90 at a location proximate to the terminal 92; and which are in sensing communication with transmission line 90 and fluid F within transmission line 90. In the example shown, sensor 108 measures a corrosion rate within line 90, sensor 110 measures an iron content within fluid F flowing in line 90, sensor 112 measures an amount of additive 12 remaining within line 90, and sensor 114 measures a water cut or moisture content in fluid F inside line 90. For the purposes of discussion herein an amount of additive 12 or chemical injection remaining in fluid F proximate the terminal 92 is referred to as residual additive. An advantage of sensing corrosion rate with sensors 104, 108 upstream and downstream of injection location 16 is to provide a baseline indication of corrosion rate without the addition of additive 12, and effectiveness of additive 12 to the corrosion rate. Examples of sensors 104, 108 include corrosion probes such as electrical resistance, linear polarization resistance, and combinations.

Additional sensors include sensor 116 shown in sensing communication with tank 14 and as illustrated measures a level of the additive 12 within tank 14; and sensor 118 is shown in sensing communication with choke valve 88, which in the example illustrated senses a percent open of the choke valve 88. For the purposes of convenience, sensors 98, 100, 102, 104, 106, 108, 110, 112, 114, 116, 118, and other sensors disclosed herein, are collectively referred to as "the sensors".

Still referring to FIG. 2, a supervisory control and data acquisition ("SCADA") controller 120 is shown that as described in more detail below optionally communicates with sensors listed above and also with controller 70 for adjusting operation of the systems described herein. A communication circuit 122 is schematically shown in signal and data communication with the SCADA controller 120, controller 70 and the sensors. In the embodiment of FIG. 2, the communication circuit 122 includes a combination of hard-wired, fiber optic, and wireless means of communication. As shown, communication circuit 122 includes a signal bus 124 represented as a dashed line and that is in selective data and signal communication with control valve 96 via lead $\mathbf{126}_1$, signal bus 124 is also in selective data and signal communication with the following sensors: sensor 118 via lead $\mathbf{126}_2$, sensor 98 via lead $\mathbf{126}_3$, sensor 100 via lead $\mathbf{126}_4$, sensor 102 via lead $\mathbf{126}_5$, sensor 104 via lead $\mathbf{126}_6$, and sensor 116 via lead $\mathbf{126}_8$. Communication circuit 122 includes another signal bus 128 that is schematically illustrated in communication with SCADA controller 120; signal bus 128 is also in communication with sensor 108 via lead $\mathbf{130}_1$, sensor 110 via lead $\mathbf{130}_2$, sensor 112 via lead $\mathbf{130}_3$, and sensor 114 via lead $\mathbf{130}_4$. An end of signal bus 128 distal from SCADA controller 120 is shown in communication with communication means 132. In the example of FIG. 2 signal bus 124, signal bus 128, controller 120, and controller 70 are in simultaneous communication with one another via communication means 132. In a non-limiting example communication circuit 112 handles signals representing information sensed or measured by the sensors and signals representing commands generated by controllers 70, 120. In an alternative, communication between the sensors and controllers 70, 120 includes information gathered real time by the sensors and historical data stored within one or both controllers 70, 120, In a non-limiting example of operation, the well 80 and wellhead 84 define an example of the injection pressure source 46 as described above with respect to FIG. 1; and that urges the additive 12 through discharge line 34, to injection location 16 and into the line 90. An advantage of driving the additive 12 into line 90 with fluid F is assurance that the motive fluid (fluid F from lead) is compatible with the treated fluid (fluid F inside line 90). In an alternate method, a flow rate or amount of additive 12 being introduced into line is controlled remotely and based upon information received from one or more of the sensors of system 76. In this example the rate of additive 12 injection is optionally proportional to the monitored flow rate of fluid F within line 90 and as measured with sensor 102. In an alternative, readings from sensor 40 are obtained to confirm a flow rate of additive 12 being introduced into line 90. Further in this example, values of water cut or moisture content are obtained from sensor 114 and which are analyzed and when water cut is at a designated value, the amount of additive 12 being added to line 90 is increased. Additional parameters for adjusting the injection rate of the additive 12 include one or more of the corrosion rate obtained from sensor 108, iron content as obtained from sensor 110, and the residual additive amount as obtained from sensor 112. In this example, percent open values of the choke valve 88 (provided via sensor 118), operating status of valve 96, temperature from sensor 98, pressure from sensor 100, additive injection rate from sensor 40, corrosion rate from sensor 104, water cut from sensor 114, iron content from sensors 106 and 110, corrosion rate from sensor 108, and residual additive from sensor 112. In this alternative, SCADA controller 120 is programmed to receive the information from the sensors remotely, and then transmit supervisory commands for adjusting either the flow rate of the fluid F within line 90, such as by adjusting the percent opening of the choke valve 88. In an example, signals from sensor 118 representing values of % choke opening together with signals from sensor 102 representing flow of fluid in line 90 are used by logic program, such as in one or both controllers 70, 120, provide an indication and/or verification of a flow rate of fluid F in line 90 based on a choke opening characteristic curve. A criteria guiding the supervisory commands is protecting the transmission line 90 from corrosion, as well as other fluids handling equipment (i.e. valves, fittings, specialty piping items) associated with transporting fluid F from wellsite 78 to terminal 92. Alternatively, the rate of the additive injection into line 90 is selectively controlled with manipulation of control valve 96 to alter the driving force of the fluid F from well 80. Further in this example is that controller 70 is in communication with chemical injection system 10 and settings of hardware within system 10 to work in conjunction with SCADA controller 120 for managing flow rates of the additive 12, such as by adjusting an opening of the pressure control valve 54 (FIG. 1) as a second let down of pressure of fluid F received from well 80. In an alternative, information from the controller 70 is captured and archived in the SCADA controller 120. An advantage of the system of FIG. 2 is a unique control system for a holistic approach to control by monitoring and managing associated parameters remotely. Also provided is an ability to archive data and generate periodic or historic reports for a complete system or parameters based on request. Historical information is available that will provide life cycle operating history and trends in basis for future planning and operation. Moreover, the disclosed system and method provides a way to control a corrosion rate and to maintain integrity of line 90 which requires corrosion protection. An advantage provided by sensors 104, 106, 108, 100, and 114, is that real time values of corrosion rates, iron content, and water cut are available and without the need to wait for a lab analysis of fluid samples collected from the flowing stream. Another advantage includes savings in logistical and testing cost as well as eliminating risk of collecting samples from pressurized and potentially hazardous flowing streams. Another advantage of the present method and system is that unlike traditional chemical injection systems that provide additive at a uniform flowrate, in the disclosed method and system an optimum injection rate of additive 12 is maintained at all times based on real time variables data and thus help optimize injection rate and maintain pipeline asset (i.e. line 90) integrity.

Figure 3:
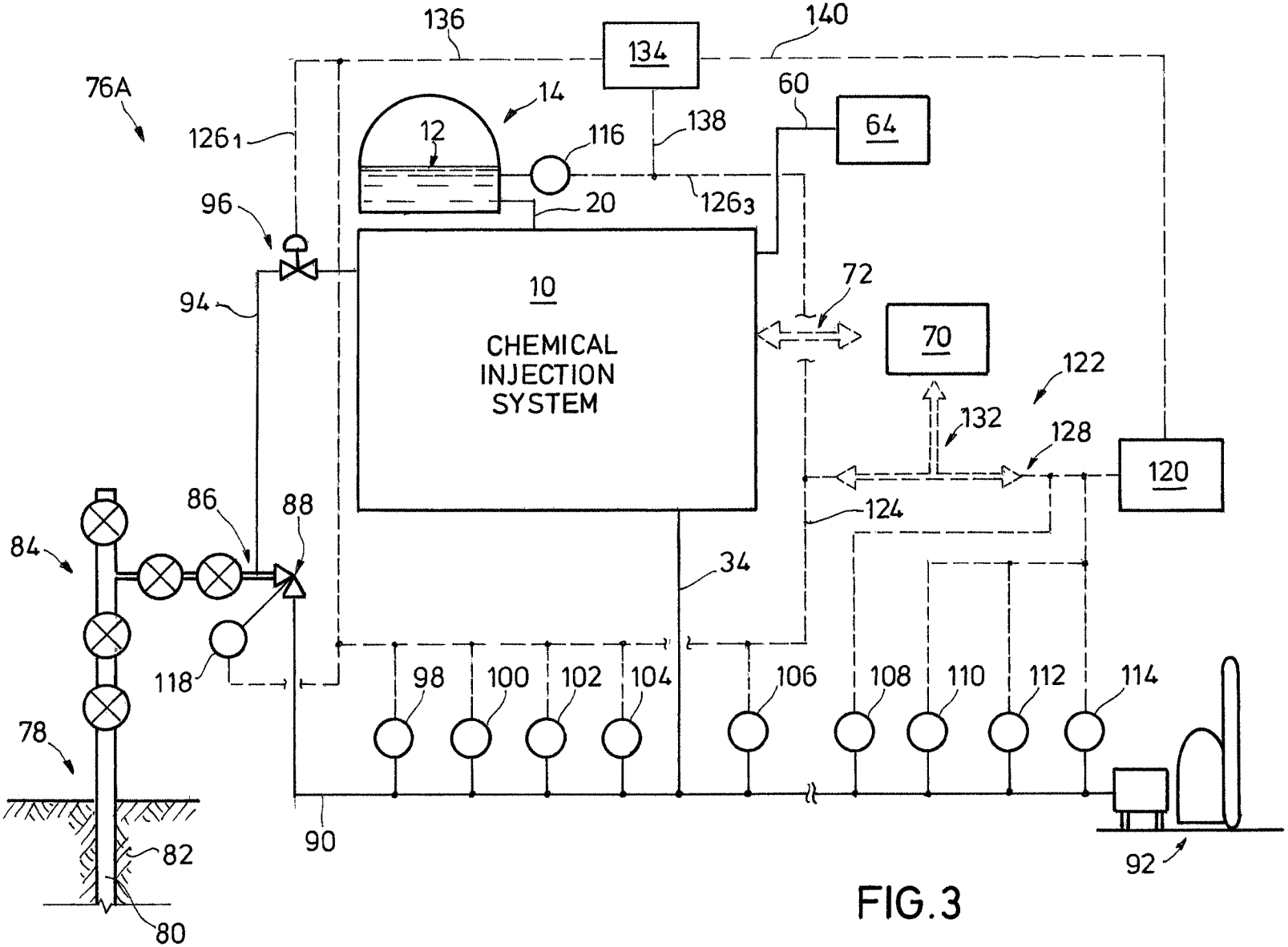
FIG. 3 is a schematic of an alternate example of injecting additive to a wellhead production line using the injection system of FIG. 1.

Referring now to FIG. 3, shown is an alternate example of a wellbore fluid production system 76A that includes a model predictive controller 134 that is shown in signal and data communication with communication circuit 122 via signal line 136, signal line 138, and signal line 140. Specifically, signal line 136 provides communication between lead $\mathbf{126}_1$ and controller 134, line 138 provides communication between controller 134 and lead $\mathbf{126}_8$, and signal line 140 is shown providing a communication link between controller 134 and directly to controller 120. In an example, a predictive model is created either experimentally or through artificial intelligence from historical data, and which correlates iron content and residual additive within fluid F flowing inside line 90. In this example, information from sensor 106, which includes a measured valve of iron content in fluid F within line 90 and downstream of injection location 16, is directed to controller 134 via signal bus 124, lead $\mathbf{126}_8$, and line 138. Based on the iron content measured in line 90 in combination with information such as, the flow rate from sensor 102 as well as corrosion rate 104, an amount of additive 12 injection is estimated to minimize residual additive and iron content within fluid F that is flowing in line 90 at or proximate terminal 92. An advantage to employing this operational criteria includes minimizing the amount of additive 12 consumed which promotes economics of the system 76A. In a non-limiting example a process model is initially formulated by direct control action based on deviation from pre-set values from field, real time data, operational experience, and historical data; and thereafter continuous real time data is used for predictive modelling and adjustment.

In one example, additive 12 includes a corrosion inhibitor; examples of which include a cathodic inhibitor, anodic inhibitor, volatile corrosion inhibitor, and mixed inhibitors. Examples of a cathodic inhibitor are sulfite, and bisulfite ions that react with oxygen to form sulfates. Types of anodic inhibitors are chromates, nitrites, orthophosphates, and molybdates. Types of volatile corrosion inhibitors are morpholine and hydrazine. Some types of mixed inhibitors are silicates and phosphates. In alternatives, additive 12 includes a corrosion inhibitor that reacts with a corrosion causing compound to neutralize the corrosion causing effects, a corrosion inhibitor that forms a film around the material being protected, or both. In this example, such as the operational example of FIG. 2, confirmation from sensors 98, 100, 102, 104, 108, 110, 112, 114, 116 and 118 are considered when determining the injection rate of additive 12 introduced into line 90. An advantage of the model predictive controller 134 is that the delay is overcome if real time values from sensors 108, 110, 112, 114 were relied on for making adjustments to the injection flow rate, which in some examples the time delay ranges up to a number of hours or more due to the time required for the fluid F to travel in line 90 when terminal 92 is distal from wellsite 78. In the example of FIG. 2, distance $D_{FE}$ is shown between sensors 106 and sensor 110 and representing the distance of the line 90 along which the fluid F travels before a second iron content reading is obtained. Similarly, a distance $D_c$ represents a distance between points where the corrosion rate is monitored within line 90. Examples of distance $D_{FE}$, $D_C$ range from the hundreds of yards, to tens or hundreds of miles Eliminating the time for the fluid F to travel these distances based upon the predictive controller and avoid instances where uncorrected and corrosive of fluid within these long stretches of line 90 are prevented. Advantages of sensors proximate wellsite 78 and also proximate terminal 92 provide comprehensive information indicating corrosion and corrosion control in line 90, regardless of the length of the line 90. Optionally, additional data from line is periodically obtained via inline inspection to provide indication of specific areas or locations which require more attention where corrosion is higher than other locations. Input of the data from inspection into the predictive model optionally provides additional criteria benchmark for changing the specifications of control limits.

In an alternate embodiment flows from multiple wellbores (not shown) are directed into one or both of the embodiments of FIG. 2 and FIG. 3, as well as gas from these wellbores directed into system 10 for providing a pressurizing source to direct additive 12 into line 90.

In a non-limiting example of operation, fluid F being produced from well 80 is routed through wellhead assembly 84 into production line 86. The percent opening of choke valve 88 is selectively adjusted to regulate a flowrate and pressure of fluid F flowing into transmission line 90. Downstream of choke valve 88 sensors 98, 100, 102, sense values of temperature, pressure, and flow of fluid F in line 90, and sensor 104 senses values of corrosion in line 90. At injection point 16, and downstream of sensors 98, 100, 102, 104, additive 12 is injected from discharge line 34 into line 90. Downstream of injection point 16 sensor 106 senses iron content of fluid F. In an example sensor is within or proximate to wellbore fluid production system 76. Downstream of sensor 106 corrosion rate in line 90 is sensed by sensor 108, and sensors 110, 112, 114 sense iron content, residual additive, and moisture content in fluid F within line 90. In embodiments, sensors 108, 110, 112, 114 are located within or proximate to terminal 92. In alternatives, sensors 108, 110, 112, 114 and/or terminal are located adjacent to wellbore fluid production system 76, located miles, tens of miles, or hundreds of miles from wellbore fluid production system 76. In an alternative, a flowrate and/or pressure of fluid F flowing lead 94 is based on a flow opening through valve 96, and a size of the opening is selectively adjusted by signal commands generated within one or more of controllers 70, 120, 134 and transmitted to valve 96 via communication circuit 122 as described above. Pressure and flowrate of fluid F flowing in line 48 (FIG. 1) is similarly controlled with adjustments to valve 54. In this alternative, valve 56 is controlled by signals from controllers 70, 120, 134 via a signal line (not shown) included in communication circuit 122. As explained above, a flowrate of additive 12 being injected into line 90 is set or adjusted is dependent on the pressure and/or flowrate of fluid F directed to vessels $\mathbf{24}_{1,2}$ in combination with sizes of orifices $\mathbf{36}_{1,2}$. As such in an example, a flowrate of additive 12 being injected into line 90 is set by controlling valve 96 and valve 54. In this example, setting the flowrate includes maintaining a particular flowrate over time and changing the flowrate to be at or substantially at a designated value. Examples of a designated value include a flowrate of additive 12 estimated by logics (software and/or hardware) within one or more of controllers 70, 120, 134, that is based on one or more of information sensed and delivered real time from the sensors, historical data sensed by the sensors, real time data from a source other than the sensors, and historical data from a source other than the sensors. Optionally, historical data provides information for maintenance planning and optimizing as well as analysis in case there is major deviation or upset that is affecting the economics and efficiency of the system 10.

For the purposes of brevity, examples exist in which information sensed by any of sensors is transmitted to and included in a calculation by one or more of controllers 70, 120, 134 to determine and transmit control commands for controlling the wellbore operation, such as adjusting opening in one or more of valves 54, 88, 96. Optionally, information provided to controllers 70, 120, 134 to generate signals for regulating pressure of fluid F entering vessels $\mathbf{24}_{1,2}$ (as described above) includes values of temperature sensed by sensor 98, values of pressure sensed by sensor 100, water cut from sensor 104, corrosion rate from sensors 104, 108, and iron content from sensors 106, 110.

In examples, an amount of iron measured in fluid F provides a measure of corrosion and an indication of a rate (lb/hr or ft3/hr) or total amount of additive 12 to be added to line 90. The measured amount of iron in fluid F alternatively provides an indication of the types of corrosion, a certain amount or rate of corrosion inhibitor injection to be added to fluid F. In an embodiment, residual corrosion inhibitor up to a specified limit is maintained to ensure adequate chemical injection is maintained to restrict corrosion. In alternatives, less than a designated amount of residual corrosion inhibitor in the fluid F introduces uncertainties in effective corrosion injection. In a further alternative, amounts of residual corrosion inhibitor above a designated amount does not proportionally decrease corrosion for the increased cost. It is within the capabilities of one skilled in the art to identify a designated amount of residual corrosion inhibitor in the fluid F at locations in line 90. Optionally, the injection rate of additive 12 is calculated based on greater of deviations measured two or more of the sensors, such as in multivariable control; examples of the measured values subject to deviations include flow rate of fluid F measured by sensor 102 and water cut measured by sensor 114.

In an example of controlling corrosion rate a rate or amount of additive 12 is injected into line 90 based on sensed values of water cut, such as from sensor 114, and the rate or amount of additive varies proportionally with water cut in fluid F. In this example, injection of additive 12 is established from initial laboratory benchmarking or field test with the particular additive 12 injected during operation of system 10; options exist in which a different additive 12 is injection, which in embodiments varies the proportionality. In another example of controlling corrosion rate a rate or amount of additive 12 is injected into line 90 is based on sensed values of iron, such as that sensed by sensor 106, sensor 110, or both; optionally the rate or amount of additive 12 injected varies proportionally with iron content sensed in fluid F. In another example of controlling corrosion rate a rate or amount of additive 12 is injected into line 90 is based on sensed values of residual corrosion inhibitor sensed by sensor 112. If there is variation in more than one variable, the higher deviation parameter will be used to control the chemical injection rate change.

In an alternative, it is within the capabilities of those skilled in the art to identify a designated value of a corrosion rate, and identify a deviation from the designated value to vary a flowrate of additive 12 into the line 90. Flowrate information sensed by sensor 40 is optionally relied on to verify a designated amount of additive 12 is being injected into line 90.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A method of handling fluid produced from a wellbore comprising:

directing produced fluid away from the wellbore by flowing the fluid through a transmission line;

lowering pressure of produced fluid in the transmission line to below wellbore pressure;

injecting an additive into the transmission line at an injection location;

monitoring characteristics inside of the transmission line, the characteristics comprising (i) a first corrosion rate upstream of the injection location, (ii) a first moisture percent downstream of the injection location, and (iii) a second corrosion rate and a second moisture content at a terminal location that is distal from the wellbore; and determining the amount of additive being injected into the transmission line based on the monitored characteristics.

2. The method of claim 1, further comprising communicating pressure from the wellbore through a lead line that has an end connected to the transmission line and a distal end in communication with a vessel containing the additive, the pressure being sufficient to drive the additive from the vessel into the transmission line.

3. The method of claim 2, further comprising controlling a flowrate of additive being injected into the transmission line by controlling pressure in the lead line.

4. The method of claim 1, wherein the additive comprises a corrosion inhibitor.

5. The method of claim 1, wherein the characteristics are monitored real time, and wherein the amount of additive being injected into the transmission line is also based on a predictive model derived using characteristics monitored historically.

6. The method of claim 1, wherein the characteristics monitored upstream of the injection location further comprise temperature, pressure, and fluid flowrate, the method further comprising, monitoring characteristics downstream of the injection location and that comprise a first iron content, and wherein the characteristics monitored at the terminal location further comprise a second iron content and residual additive.

7. The method of claim 1, wherein the produced fluid pressure is lowered with a choke valve.

8. The method of claim 1, wherein the fluid comprises fluid from multiple wellbores.

9. A method of handling fluid produced from a wellbore comprising:

monitoring a flow rate and moisture percent of the fluid and that is flowing inside the transmission line;

injecting an additive into the transmission line at a rate that is based on the gas flow rate and the moisture percent;

using fluid from the wellbore to drive the additive into the transmission line;

reducing pressure in the transmission line to below wellbore pressure;

monitoring a characteristic in the transmission line that is selected from the group consisting of corrosion rate in the transmission line, iron content of the fluid in the line, an amount of residual additive in the fluid, and combinations, and at a location that is downstream of where the additive is injected; and adjusting a rate of the additive injected into the transmission line based on the monitored characteristic.

10. The method of claim 9, wherein the additive comprises a corrosion inhibitor.

11. The method of claim 9 further comprising altering the flow rate of the fluid flowing inside the transmission line by adjusting a percent opening of a choke valve disposed in the transmission line.

12. The method of claim 9, wherein the corrosion rate is measured downstream of where the additive is injected into the transmission line, the method further comprising measuring a corrosion rate upstream of where the additive is injected into the transmission line, and wherein the monitored characteristic comprises corrosion rates measured upstream and downstream of where the additive is injected into the transmission line.

13. A method of handling fluid produced from a wellbore comprising:

flowing the fluid to a destination away from the wellbore and through a transmission line;

reducing pressure in the transmission line to below that of the wellbore;

monitoring a first corrosion rate at a first location in the transmission line and a second corrosion rate at a second location in the transmission line that is distal from the first location; and injecting an amount of the additive into the transmission line downstream of where the pressure is reduced and basing the amount on monitoring the first and second corrosion rates.

14. The method of claim 13 wherein the additive comprises a corrosion inhibitor, and wherein the model is obtained from historical data.

15. The method of claim 13, wherein the characteristics are selected from a group consisting of temperature, pressure, fluid flow rate, iron content in the fluid at a location downstream of where the additive is injected, residual additive in the fluid, and moisture content of the fluid at the destination.

* * * * *